US007880075B2

(12) United States Patent
Shigenaga

(10) Patent No.: US 7,880,075 B2
(45) Date of Patent: Feb. 1, 2011

(54) ANGLE ADJUSTING STRUCTURE FOR HIGH-HAT CYMBALS

(75) Inventor: Fumihiro Shigenaga, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/630,033

(22) Filed: Dec. 3, 2009

(65) Prior Publication Data

US 2010/0147136 A1 Jun. 17, 2010

(30) Foreign Application Priority Data

Dec. 17, 2008 (JP) ..... 2008-320553

(51) Int. Cl.
*G10D 13/02* (2006.01)

(52) U.S. Cl. ..... 84/422.1

(58) Field of Classification Search ..... 84/422.1, 84/422.3, 422.2, 421
See application file for complete search history.

(56) References Cited

U.S. PATENT DOCUMENTS 6,417,434 B1 * 7/2002 Lao ..... 84/422.3
7,078,606 B2 7/2006 Tanaka

FOREIGN PATENT DOCUMENTS

JP 2559420 Y2 1/1998

* cited by examiner

*Primary Examiner*—Kimberly R Lockett
(74) *Attorney, Agent, or Firm*—Dickstein Shapiro LLP

(57) ABSTRACT

An angle adjusting structure adapted to a high-hat stand supporting the high-hat cymbals is constituted of a receiving member supporting high-hat cymbals, a first thread attached to the receiving member, a second thread which engages with the first thread and which is revolved to move the first thread up/down so as to adjust a tilting angle of the receiving member, a support member supporting the second thread, and a revolution limiting member limiting the revolution of the second thread. The revolution limiting member includes a plurality of first engagers (e.g. recesses) which are formed on the lower end of the second thread in its circumferential direction and a second engager (e.g. a projection) which is shaped to engage with the first engager and is attached to the support member.

5 Claims, 3 Drawing Sheets

ANGLE ADJUSTING STRUCTURE FOR HIGH-HAT CYMBALS

BACKGROUND OF THE INVENTION

1. Field of the Invention

The present invention relates to angle adjusting structures for high-hat cymbals which prevent angles of the high-hat cymbals from being involuntarily varied during performance.

The present application claims priority on Japanese Patent Application No. 2008-320553, the content of which is incorporated herein by reference.

2. Description of the Related Art

Conventionally, high-hat stands have been widely used to support high-hat cymbals and disclosed in various documents.

Patent Document 1: Japanese Utility Model No. 2559420

Patent Document 2: U.S. Pat. No. 7,078,606

Patent Document 1 discloses a cymbal receiving structure for high-hat cymbals which includes a receiving plate for receiving the lower portion of the high-hat cymbals, a bolt disposed beneath the receiving plate, and a nut engaged with the bolt. The cymbal receiving structure adjusts a tilting angle of the high-hat cymbals in such a way that the bolt is revolved to move up/down so as to vary the tilting of the receiving plate above the bolt.

During performance, vibration and/or impact may easily cause the bolt to involuntarily revolve, thus involuntary varying the tilting angle of the high-hat cymbals. To avoid such an event, the cymbal receiving structure incorporates a lock nut engaged with the bolt, wherein after completion in adjusting the angle by revolving the bolt, the lock nut is operated to tighten the bolt and to thereby prevent the bolt from being involuntarily revolved.

Patent Document 2 discloses another structure for limiting the revolution of the bolt and the nut, wherein the nut is revolved to move the bolt up/down so as to adjust the tilting angle of the high-hat cymbals. This structure incorporates a spring that axially presses the bolt so as to increase the friction between the bolt and the nut, thus limiting the revolution of the nut.

The structure of Patent Document 1 needs the tightening of the lock nut in addition to the revolution of the bolt to limit the further revolution of the bolt. Every time the tilting angle of the high-hat cymbals needs adjusting, the structure needs to release the tightening of the lock nut and then to tighten the lock nut again. That is, the structure requires a troublesome and time-consuming operation to adjust the angle of the high-hat cymbals.

The structure of Patent Document 2 is disadvantageous in that increasing the resilience of the spring increases the power for revolting the nut and decreases the workability in adjusting the angle of the high-hat cymbals. Since the structure uses the friction of thread groves between the bolt and the nut in limiting the involuntary revolution of the bolt and the nut, repeated vibration and/or impact in performance briefly varies the friction and therefore causes difficulty in limiting the revolution of the bolt steadily. Decreasing the resilience of the spring may improve the workability but may cause further difficulty in limiting the revolution of the bolt during performance.

SUMMARY OF THE INVENTION

It is an object of the present invention to provide an angle adjusting structure for high-hat cymbals, which reliably prevents the angle of the high-hat cymbals from being involuntarily varied during performance and which improves the workability in adjusting the angle of the high-hat cymbals.

The present invention is directed to an angle adjusting structure adapted to a high-hat stand supporting the high-hat cymbals. The angle adjusting structure includes a receiving member supporting the high-hat cymbals, a first thread (e.g. an external thread) attached to the receiving member, a second thread (e.g. an internal thread) which engages with the first thread and which is revolved to move the first thread up/down so as to adjust a tilting angle of the receiving member, a support member supporting the second thread, and a revolution limiting member limiting the revolution of the second thread. The revolution limiting member includes a plurality of first engagers which are formed in the second thread in its circumferential direction, and a second engager which is shaped to engage with the first engager and is attached to the support member.

In the above, the first engagers are recesses, while the second engager is a projection shaped to engage with the recess, wherein the second thread is pressed by a pressing member in a direction of engagement between the recess and the projection. In addition, the first engagers are collectively formed in a saw-toothed manner.

According to the present invention, the engagement of the first and second engagers limits the further revolution of the second thread due to vibration and/or impact during performance, thus reliably preventing the angle of the receiving member from being involuntarily varied. Selectively engaging one of the first engagers with the second engager limits the further revolution of the second thread while simultaneously adjusting the angle of the high-hat cymbals. This markedly reduces the working time in adjusting the angle of the high-hat cymbals and is less troublesome than the conventional structures.

Even though the pressing member exerts pressure on the second thread in the engaging direction of the first and second engagers, it is possible to revolve the second thread under the condition that the first and second engagers are detached from each other despite the exerted pressure. This maintains a good engagement of the first and second engagers while preventing the involuntary revolution of the second thread, wherein it is possible to improve the workability in adjusting the angle of the high-hat cymbals.

Due to the saw-toothed alignment of the first engagers, an applied external force causes the second thread to revolve so that the adjacent first engager can smoothly engage with the second engager. This further improves the operability of the second thread.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
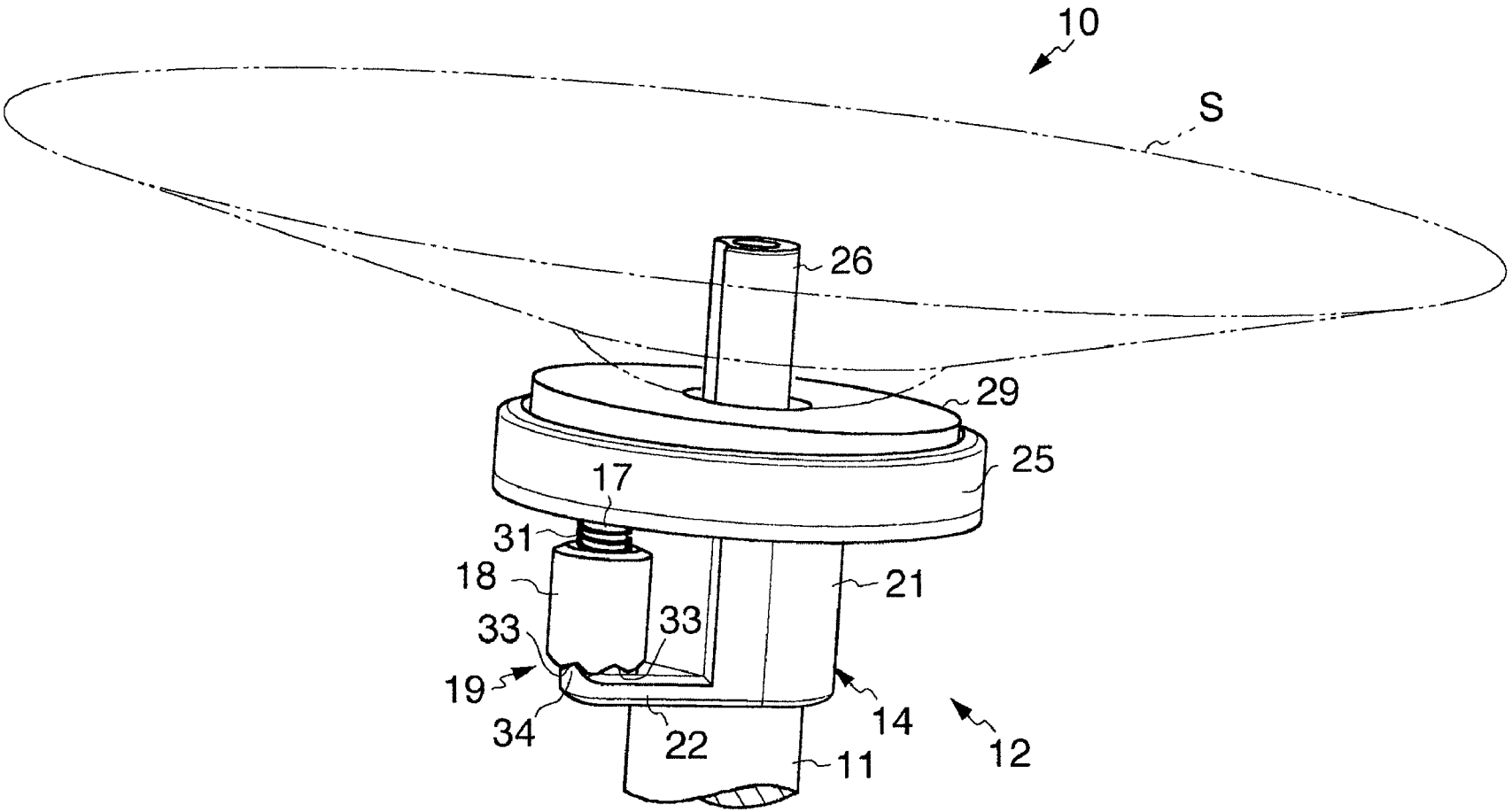
FIG. 1 is a partially transparent perspective view showing a high-hat stand adopting an angle adjusting structure according to an embodiment of the present invention.
Figure 2:
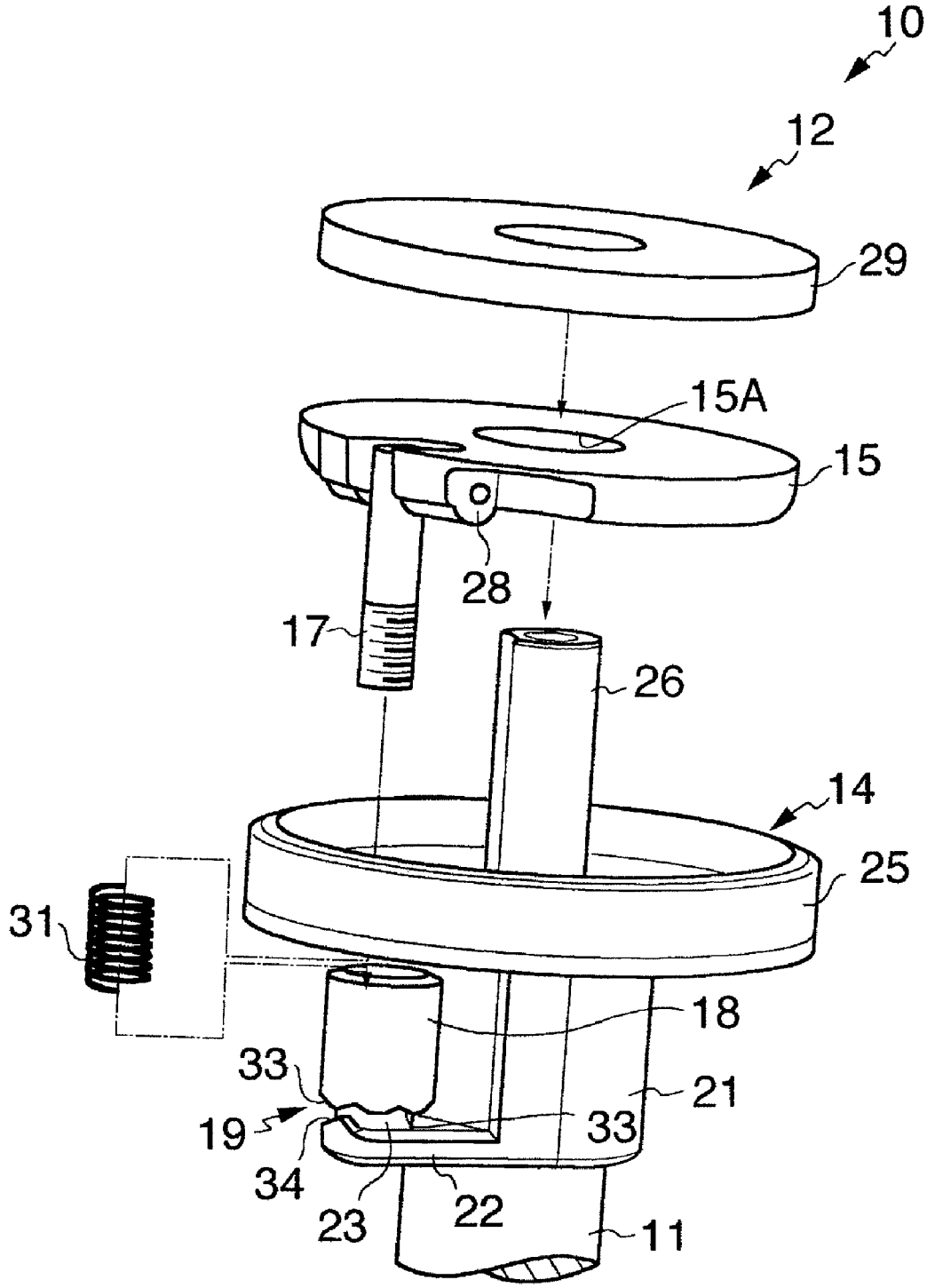
FIG. 2 is an exploded perspective view of the high-hat stand.
Figure 3:
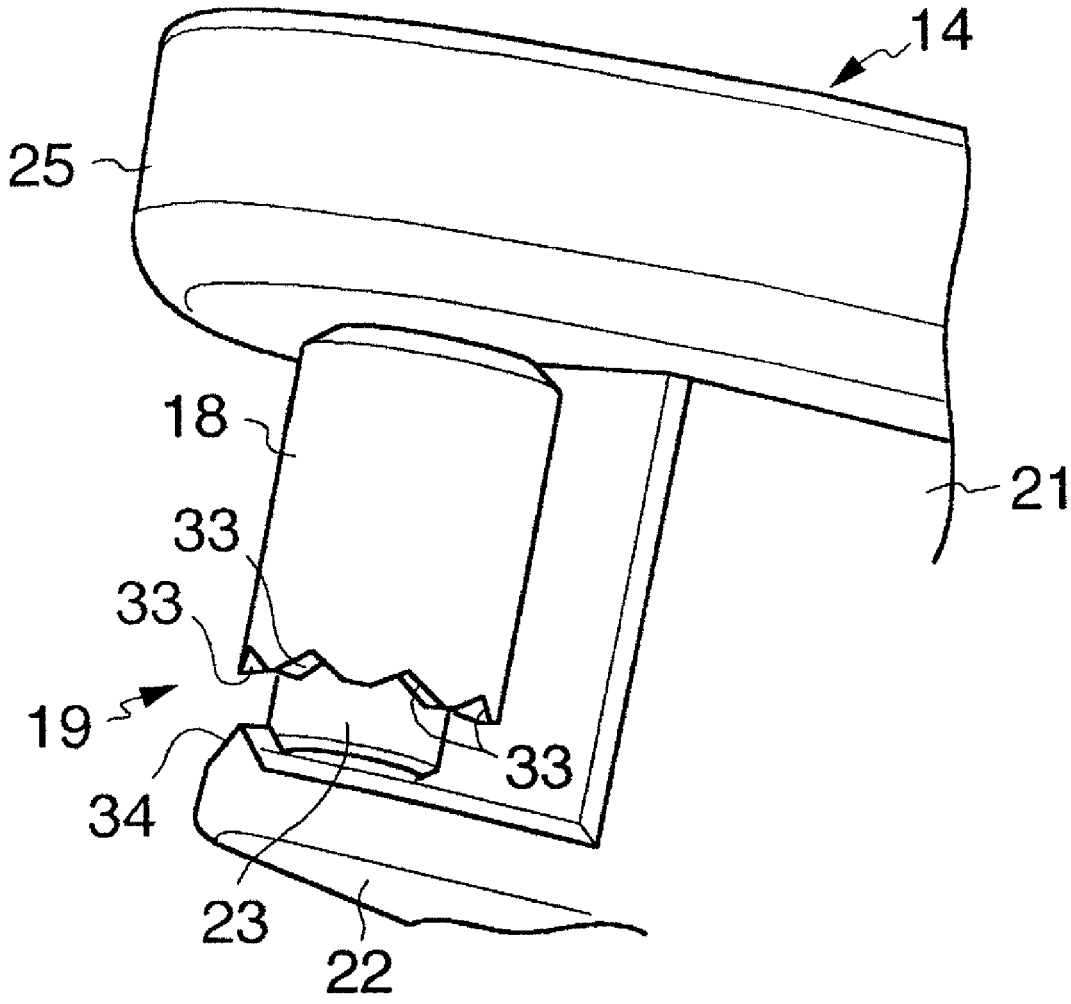
FIG. 3 is a perspective lower view showing essential parts of the high-hat stand.

FIG. 1 is a partially transparent perspective view showing a high-hat stand 10 adopting an angle adjusting structure 12 according to an embodiment of the present invention. FIG. 2 is an exploded perspective view of the high-hat stand 10, and FIG. 3 is a perspective lower view showing essential parts of the high-hat stand 10.

The high-hat stand 10 is equipped with the angle adjusting structure 12, which is attached to the upper portion of a stand pipe 11 vertically disposed on the ground via legs (not shown). The angle adjusting structure 12 is constituted of a support member 14 (which is interconnected to the upper end of the stand pipe 11), a receiving member 15 (which is disposed above the support member 14 and which supports the lower portion of high-hat cymbals S), an external thread 17 (i.e. a bolt which projects downwardly from the receiving member 15), an internal thread 18 (i.e. a nut 18 which engages with the bolt 17 and which is supported by the support member 14), and a revolution limiting member 19 (which limits the revolution of the internal thread 18).

The support member 14 is constituted of a support body 21 (which is fixed to the upper end of the stand pipe 11 and whose diameter is larger than the diameter of the stand pipe 11), an extension 22 (which laterally extends from the side surface of the support body 21), an axially-shaped guide member 23 (which is vertically disposed on the extension 22), a tray 25 (which is interconnected to the upper end of the support body 21 so as to receive the receiving member 15 therein), and a tubular member 26 (which is vertically disposed on the center portion of the tray 25). The guide member 23 is inserted into the internal thread 18 so as to guide the vertical movement of the internal thread 18. A hole (not shown) is formed at the prescribed position of the tray 25 so as to allow the insertion of the external thread 17 therethrough. The external thread 17 penetrating through the hole of the tray 25 is engaged with the internal thread 18.

The receiving member 15 is a circular plate in plan view having a hole 15A allowing the insertion of the tubular member 26 therethrough. The receiving member 15 is revolutionarily interconnected to the upper end of the external thread 17 via a hinge 28. Moving up/down the external thread 17 makes the hinge 28 of the receiving member 15 reciprocate up/down, thus varying the tilting angle of the receiving member 15 with respect to the horizontal plane. A cushion 29 having a sheet-like shape is attached to the upper surface of the receiving member 15. The high-hat cymbals S are mounted on the cushion S.

The internal thread 18 inserting the guide member 23 therein is engaged with the distal end of the external thread 17 penetrating through the tray 25. The internal thread 18 is revolutionarily operated in the circumferential direction so as to make the external thread 17 (which is retractably inserted in the internal thread 18) move up/down. A pressing member 31 composed of a coil spring is interposed between the upper end of the internal thread 18 and the lower surface of the tray 25. The external thread 17 is inserted into the internal space of the pressing member 31 with the reliance normally pressing the internal thread 18 downwardly.

A plurality of triangular recesses 33 is formed on the lower end of the internal thread 18, while a triangular projection 34 is formed at the distal end of the extension 22 so as to engage with one triangular recess 33. Each triangular recess 33 whose opening is directed downwardly is defined by a pair of slopes so that the width thereof becomes large in the downward direction. The triangular recesses are consecutively aligned in the circumferential direction of the internal thread 18 so that the lower end of the internal thread 18 has a saw-toothed shape. The triangular projection 34 (i.e. an upward crest) is defined by a pair of slopes which fits with a pair of slopes of the triangular recess 33. The engagement between the triangular recess 33 and the triangular projection 34 limits the revolution of the internal thread 18.

Next, an angle adjusting method of the high-hat cymbals S will be described in conjunction with the angle adjusting structure 12.

As shown in FIG. 1, the high-hat cymbals S are mounted on the cushion 29. The internal thread 18 is pressed in the prescribed direction (i.e. a lower direction in FIG. 1 in which the triangular recess 33 is engaged with the triangular projection 34) by the pressing member 31. In this state, the angle of the high-hat cymbals S is adjusted by revolving the internal thread 18 in the circumferential direction. This makes the external thread 17 move up/down in response to the revolving direction of the internal thread 18 so that the hinge 28 of the receiving member 15 correspondingly reciprocate up/down, thus adjusting the tilting angle of the high-hat cymbals S.

The operation of the internal thread 18 will be described in detail. An applied external force causes the internal thread 18 to revolve so that the triangular recess 33 and the triangular projection 34 slide along each other with their slopes, wherein the compulsory revolution slightly moves the internal thread 18 upwardly despite the downward pressure of the pressing member 31. The triangular recess 33 does not engage with the triangular projection 34 now that their slopes do not contact with each other due to the revolution of the internal thread 18. Subsequently, an adjacent triangular recess 33 which adjoins the above triangular recess 33 in the direction opposite to the revolving direction is engaged with the triangular projection 34. That is, the revolving operation of the internal thread 18 adjusts the angle of the high-hat cymbals S in such a way that the adjacent triangular recess 33 engages with the triangular projection 34 so as to limit the further revolution of the internal thread 18.

The operation of the internal thread 18 can be changed as follows:

First, the internal thread 18 is slightly moved upwardly despite the downward pressure of the pressing member 31 such that the slopes of the triangular recess 33 detach from the slopes of the triangular projection 34. This state is maintained while the internal thread 18 is revolved at a prescribed angle; subsequently, the internal thread 18 is released so as to move downwardly due to the downward pressure of the pressing member 31, thus making the adjacent triangular recess 33 engage with the triangular projection 34. This allows the external thread 17 to move up/down so as to adjust the tilting angle of the receiving member 15.

According to the present embodiment, in the normal state, the triangular recess 33 engages with the triangular projection 34 while the internal thread 18 is pressed in the engaging direction via the pressing member 31. Thus, it is possible to prevent the engagement between the triangular recess 33 and the triangular projection 34 from being involuntarily released due to vibration and/or impact during performance, thus preventing the tilting angle of the high-hat cymbals S from being inadvertently varied due to the revolution of the internal thread 18.

Simple operation of the internal thread 18 reliably adjusts the angle of the receiving member 15 and locks the revolution of the internal thread 18; hence, it is possible to speed up the operation without any problem.

The present invention is not necessarily limited to the present embodiment, which can be modified without departing from the basic concept and objectivity of the present invention since a skilled person in the art can conceive various variations on the shape, position, and arrangement of parts of the high-hat stand. In addition, the shapes, positions, and arrangements of the aforementioned parts of the high-hat stand 10 are illustrative and not restrictive For example, the upper end of the external thread 17 does not need to be interconnected to the receiving member 15; that is, the receiving member 15 can be mounted on the upper end of the external thread 17. Similar to the present embodiment, this variation is capable of adjusting the tilting angle of the receiving member 15.

It is possible to employ various shapes such as semicircular shapes and rectangular shapes for the recess 33 and the projection 34. In this connection, the present embodiment employs triangular shapes for the recess 33 and the projection 34 because of the good engagement therebetween, ensuring the simultaneous revolution and axial movement of the internal thread 18 by way of the sliding movement of the slopes of the recess 33 and the projection 34.

It is possible to change the relationship between the two threads 17 and 18 in such a way that the thread 17 is changed to an internal thread, while the thread 18 is changed to an external thread. In this case, the external thread 18 is revolutionarily supported by the support body 14, and a plurality of triangular recesses 33 is formed in the lower end of the external thread 18 in its circumferential direction. The internal thread 17 is attached to the receiving member 15 and is engaged with the external thread 18 so that the revolution of the external thread 18 makes the internal thread 17 move up/down so as to vary the angle of the receiving member 15.

Lastly, the present embodiment can be further modified in various ways within the scope of the invention as defined in the appended claims.

What is claimed is:

1. An angle adjusting structure adapted to a high-hat stand supporting high-hat cymbals, comprising:

a receiving member supporting the high-hat cymbals;

a first thread attached to the receiving member;

a second thread which engages with the first thread and which is revolved to move the first thread up/down so as to adjust a tilting angle of the receiving member;

a support member supporting the second thread; and a revolution limiting member limiting the revolution of the second thread, wherein the revolution limiting member includes a plurality of first engagers which are formed in the second thread in its circumferential direction, and a second engager which is shaped to engage with the first engager and is attached to the support member.

2. The angle adjusting structure according to claim 1, wherein the first engagers are recesses, and the second engager is a projection shaped to engage with the recess, and wherein the second thread is pressed by a pressing member in a direction of engagement between the recess and the projection.

3. The angle adjusting structure according to claim 1, wherein the plurality of first engagers is formed in a saw-toothed manner.

4. The angle adjusting structure according to claim 1, wherein the support member includes a support body, an extension laterally extended from the support body, a guide member vertically disposed on the extension, and a tray which is interconnected to the upper end of the support body so as to receive the receiving member therein, wherein the guide member guides the second thread whose first engager is detachably engaged with the second engager formed at a distal end of the extension.

5. The angle adjusting structure according to claim 1, wherein the first thread is an external thread, and the second thread is an internal thread, so that the external thread is retractably moved up/down with the internal thread being revolved.

* * * * *